United States Patent [19]

Vidmar

[11] 4,109,144

[45] Aug. 22, 1978

[54] DUST COLLECTION AND ILLUMINATION SYSTEM

[75] Inventor: Albert J. Vidmar, Mentor, Ohio

[73] Assignee: Sherwood Refractories Inc., Cleveland, Ohio

[21] Appl. No.: 603,353

[22] Filed: Aug. 11, 1975

[51] Int. Cl.[2] ..... F21V 33/00

[52] U.S. Cl. .....362/247; 362/294; 362/427; 362/282; 55/385 R; 98/43 B

[58] Field of Search ..... 240/47, 9 A, 9 R, 2 VC, 240/52 R, 73 BJ, 2 D, 2 V; 98/40 DL; 55/385

[56] References Cited

U.S. PATENT DOCUMENTS

| | | | |
|---|---|---|---|
| 2,875,679 | 3/1959 | Humpert | 55/385 R X |
| 3,103,156 | 9/1963 | Quin | 240/9 A |
| 3,374,347 | 3/1968 | Hirose | 240/52 R |
| 3,510,228 | 5/1970 | May | 240/51.12 X |
| 3,785,271 | 1/1974 | Joy | 240/9 A X |
| 3,890,126 | 6/1975 | Joseph | 240/47 X |

*Primary Examiner*—J. D. Miller
*Assistant Examiner*—Peter S. Wong

[57] ABSTRACT

An improved dust collection and illumination system is utilized in association with a plurality of work areas at which dust particles are formed during work operations. A combination lamp and dust collector is mounted on a workbench at each of the work areas and is connected with an exhaust manifold which conducts a flow of air and dust particles from the work areas to the intake of a blower. Each combination lamp and dust collector includes a reflector which is connected with the manifold by a flexible conduit and a light bulb which is mounted in the reflector and is effective to illuminate a work surface. Air and dust particles are drawn into the reflector, around the light bulb to cool the bulb, and through the flexible conduit and manifold to the blower. A linkage is utilized to support the reflector above the work surface. This linkage is adjustable to enable the position of the reflector to be changed.

12 Claims, 4 Drawing Figures

DUST COLLECTION AND ILLUMINATION SYSTEM

BACKGROUND OF THE INVENTION

The present invention relates to an illumination and dust collection system and more specifically to a new and improved combination lamp and dust collector.

During the manufacture of many different articles, such as relatively small mold cores, dust is generated. In order to protect the workers from the dust, relatively large fixed hoods or casings have been provided around the work area. These casings are connected with a source of suction, such as a blower, which draws air and dust particles from the work area. Due to the fact that the hoods or casings enclose a relatively large area, the blower must have a very large capacity and is effective to draw a large volume of air from the work area. Of course, the large volume of air which is with drawn from the work area must be replaced. Such a dust collection system involves substantial costs due to the relatively large initial cost of the hoods or casings and the cost of replacing the large volume of heated air which is withdrawn from the work area during the winter and the large volume of cooled air which is withdrawn from the work area during the summer.

In an effort to remove the dust which is formed during a work operation, it has been suggested that the work tools be connected with a source of vacuum in the manner disclosed in U.S. Pat. No. 2,852,051. It has also been suggested that light bulbs be mounted on the tools to illuminate the work area. Although such a dust collection and illumination system may be satisfactory for certain relatively large tools during work operations in which the tools are manipulated in such a manner as to enable the tool mounted light bulbs to illuminate the work piece, this arrangement is unsatisfactory for use in connection with relatively small hand tools which are utilized to finish small delicate parts, such a small mold cores utilized in the formation of turbine blades.

In order to provide the desired illumination of an area where small hand tools are used to perform delicate operations, it has been suggested that an adjustable high intensity lamp be utilized in the manner disclosed in U.S. Pat. No. 3,609,335. Since there is a substantial amount of heat generated by the bulb of such a high intensity lamp, a flow of air has been provided around the bulb to cool the bulb. Another known arrangement for cooling a source of light is disclosed in U.S. Pat. No. 1.767,526.

SUMMARY OF THE PRESENT INVENTION

The present invention provides a new and improved illumination and dust collection system which is particularly well adapted for use in association with a plurality of work areas at which dust is generated by the use of small hand tools. This improved dust collection and illumination system includes a plurality of combination lamp and dust collectors. A combination lamp and dust collector is located at each of the work areas and is connected with a common manifold leading to the inlet of a blower.

Each of the combination lamp and dust collectors includes a reflector which is connected in fluid communication with the manifold by a flexible conduit. The reflector is supported above the work area and has an open bulb receiving cavity. Operation of the blower causes a flow of air and dust to be drawn from the work area through the reflector and around the bulb to cool the bulb. This flow of air and dust then passes through the flexible conduit to the manifold and the inlet of the blower. The position of each of the reflectors can be adjusted relative to a workpiece so that it can be located closely adjacent to a workpiece to clearly illuminate the workpiece and to enable the flow of a relatively small volume of air from the work area to remove the dust generated during work operations.

Accordingly, it is an object of this invention to provide an illumination and dust collection system which includes a new and improved combination lamp and dust collector which is supported over a work area and is adjustable relative to a workpiece and performs the dual functions of removing dust formed adjacent to the workpiece and illuminating the workpiece.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
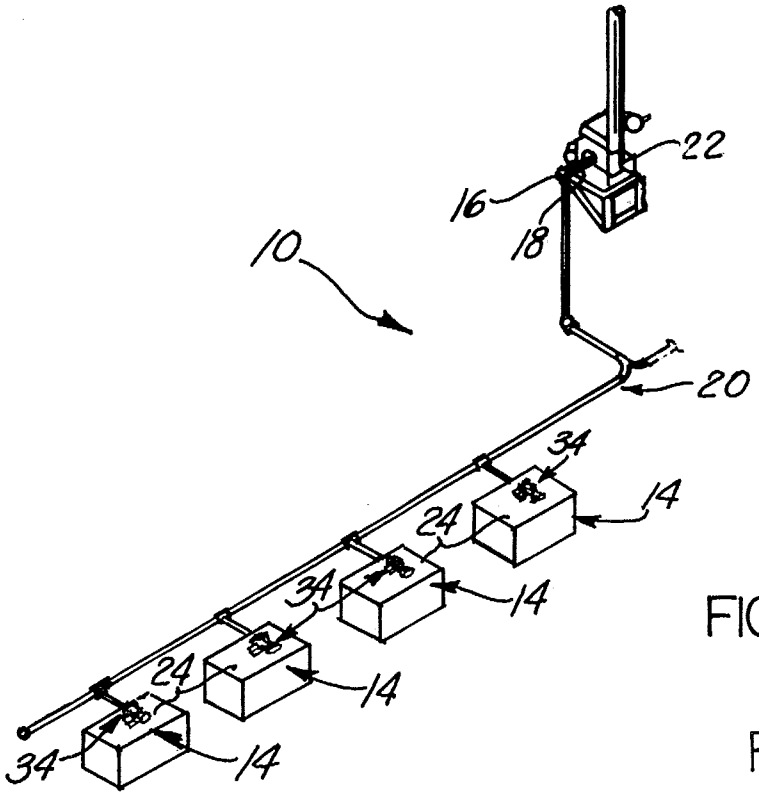
FIG. 1 is a schematic illustration of an improved illumination and dust collection system constructed in accordance with the present invention and utilized in association with a plurality of work areas.

An improved illumination and dust collection system 10 is illustrated schematically in FIG. 1 and is utilized to illuminate workpieces at a plurality of work areas 14 and to remove dust generated during operations on the workpieces. The illumination and dust collection system 10 includes a blower 16 having an inlet 18 which is connected in fluid communication with each of the work areas 14 by a manifold 20. The blower 16 has an outlet 22 from which air and dust particles drawn from the work areas 14 through the manifold 20 are exhausted.

Figure 2:
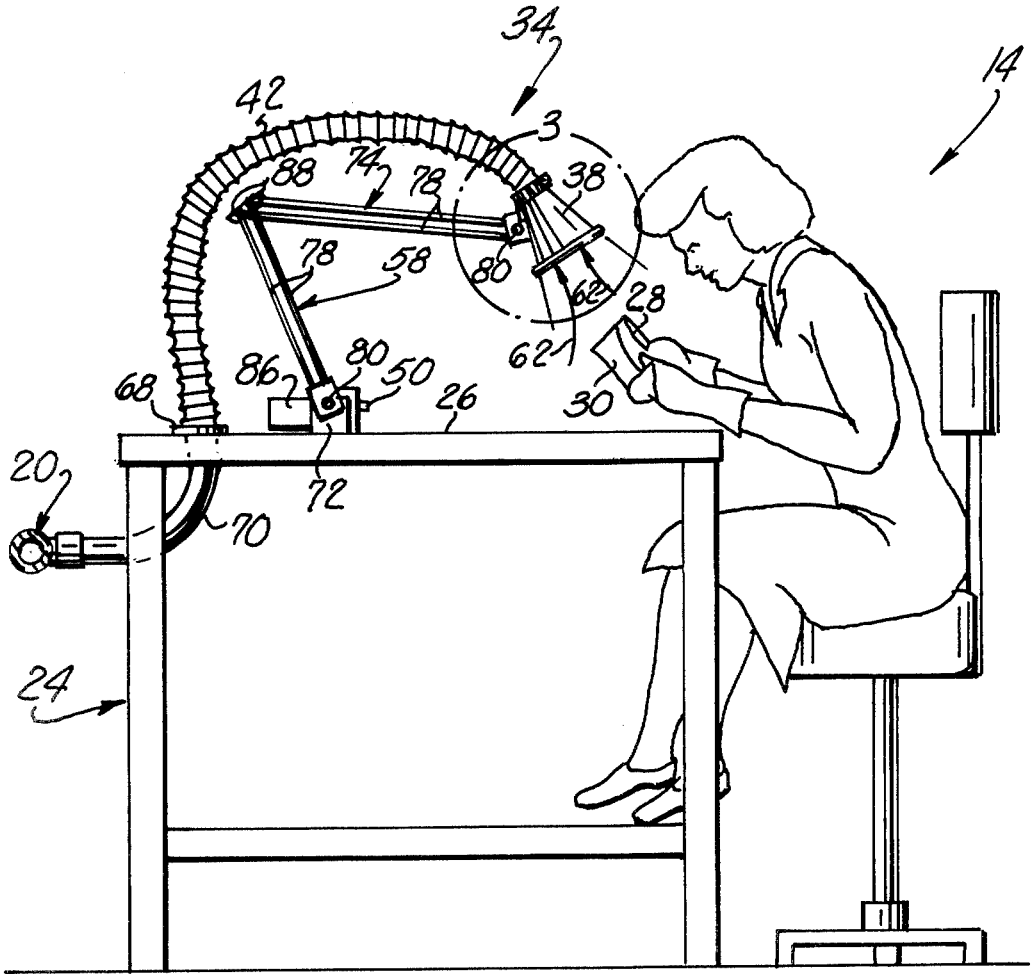
FIG. 2 is an enlarged illustration of one of the work areas of FIG. 1.

A workbench or table 24 having a flat work surface 26 (see FIG. 2) is provided at each of the work areas 14. During work operations at the table 24, a small hand tool, such as a file or rasp 28, is utilized to shape a small workpiece 30. As the workpiece 30 is shaped, dust is formed at the work area. Inhalation of this dust would be annoying to an operator. Accordingly, a combination lamp and dust collector 34 is provided at each of the work areas 14. The combination lamp and dust collector 34 performs the dual functions of illuminating the workpiece 30 and withdrawing the dust from the area adjacent to the workpiece. It should be noted that the combination lamp and dust collector 34 is positioned immediately adjacent to the workpiece to maximize the illumination of the workpiece and to enable the withdrawal of a relatively small volume of air to remove the dust from the work area.

Figure 3:
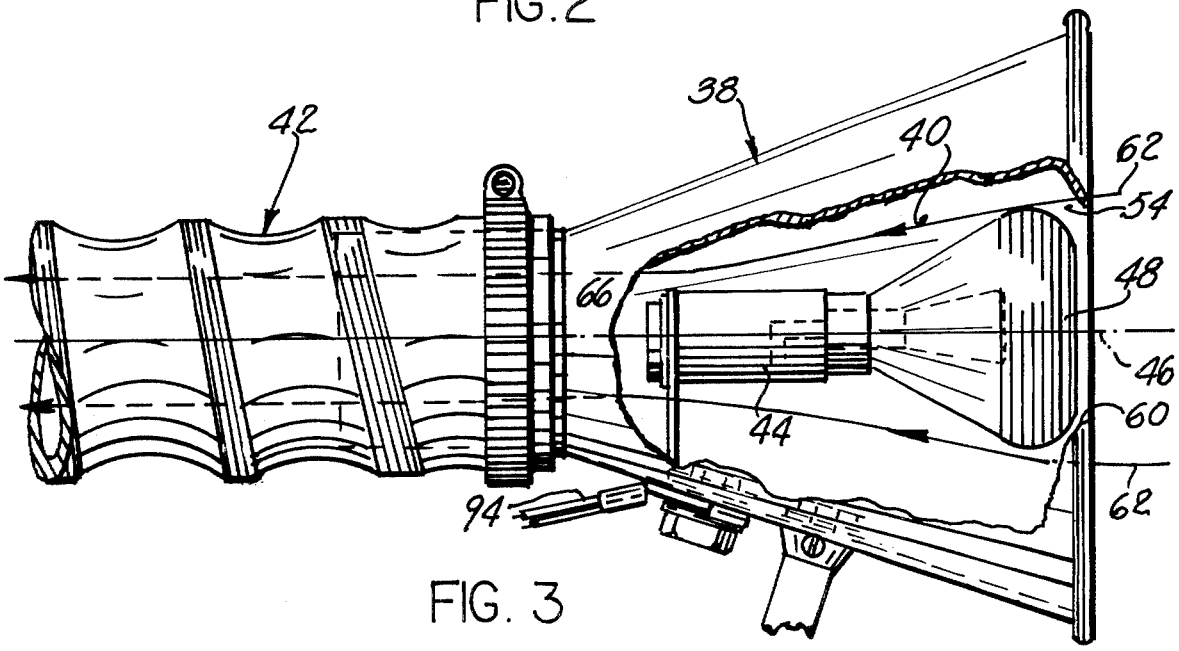
FIG. 3 is an enlarged fragmentary view illustrating the construction of a combination lamp and dust collector utilized at each of the work areas of FIG. 1.

The combination lamp and dust collector 34 includes a generally frustroconical reflector 38 which defines a cavity 40 (FIG. 3) connected with a flexible conduit 42.

An electrical socket 44 is disposed along the central axis 46 of the generally frustroconical cavity 40 and the conduit 42 to support a high intensity light bulb 48 in the center of the cavity. Upon actuation of a switch 50 (FIGS. 2 and 4) the light bulb 48 is energized. Upon energization of the bulb 48, a polished inner surface 54 (FIG. 3) of the reflector 38 reflects light downwardly onto the workpiece 30 to illuminate the workpiece. The reflector 38 is supported by an adjustable linkage 58 (see FIG. 2) to enable the postion of the reflector to be changed to suit the reguirements of different operators as they perform work operations on different workpieces 30.

In accordance with a feature of the invention, a stream of air and dust particles are drawn from the area around the workpiece 30, through the reflector 38 and flexible conduit 42 to the manifold 20 which is connected in fluid communication with the outlet 22 of the blower 16. Thus, the reflector 38 has a circular open main end portion 60 through which air and dust particles flow from the area adjacent the workpiece 30 in the manner illustrated by the arrows 62 in FIG. 2. This flow of air impinges against the light bulb 48 to cool the bulb. In addition, the flow of air also impinges against the inner surface 54 of the reflector to cool the reflector and thereby prevent the operator from being burned by contact with the reflector.

The flow of air and dust particles passes through a circular opening 66 at the rear of the reflector 38 and into the conduit 42. A connector 68 is fixedly mounted on the table 24 (see FIG. 2) and connects the flexible conduit 42 in fluid communication with the rigid tubing of the manifold 20 through a rigid manifold branch tube 70. The air and dust particles are exhausted from the building by the blower 16.

The support structure 58 for the reflector 38 includes a base bracket 72 (FIG. 2) which is fixedly mounted on the workbench 24. A linkage assembly 74 is pivotally connected with the base bracket 72 and the reflector 38. This linkage assembly includes a plurality of rigid links 78 which are pivotally connected with each other, the base bracket 72 and the reflector 38 at suitable connections 80. When the position of the reflector 38 is to be changed, it is merely necessary for the operator to manually grasp the reflector and move it. As this occurs, the linkage 74 is actuated to flex the conduit 42 and vary the position of the reflector. Since the construction of the linkage 74 is similar to many known constructions, it will not be further described herein to avoid prolixity of description.

Figure 4:
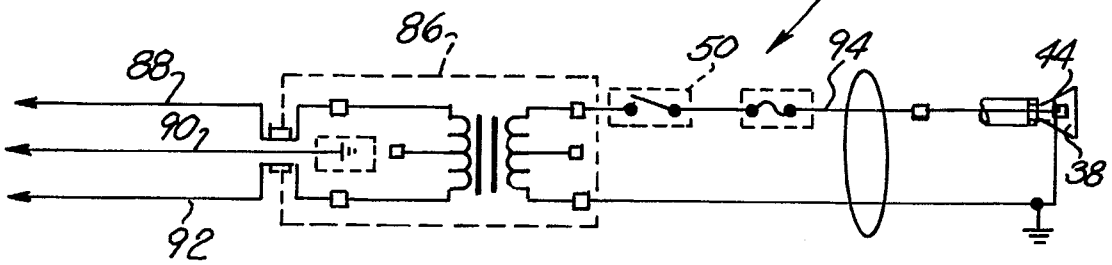
FIG. 4 is a schematic illustration of electrical circuitry utilized in association with the combination lamp and dust collector of FIG. 3.

The bulb 40 is energized by an electrical circuit 84 which is illustrated schematically in FIG. 4. This electrical circuit includes a transformer 86 which is connected with a 110 volt power source by leads 88, 90 and 92. The transformer 86 has a 7.5 volt output which is conducted to the high intensity light bulb 48 over a lead 94 when the switch 50 is closed. The transformer 86 is fixedly connected with the workbench 24 at the bracket 72.

Since the position of the reflector 38 can be adjusted so that it is relatively close to the workpiece 30, the illumination of the workpiece 30 by the bulb 48 is maximized without interferring with operations on the workpiece. In addition, the close proximity of the reflector 38 enables the dust generated during a work operation to be removed from the work area by the flow of a relatively small volume of air through the reflector and flexible conduit 42 to the manifold 20 and blower 16. Since a relatively small volume of air is required to remove the dust from the work area, operating expenses tend to be minimized since a relatively small volume of heated or cooled replacement air is to be supplied to the work area.

Having described one specific preferred embodiment of the invention, the following is claimed:

1. An apparatus for use in illuminating a work surface and removing dust particles from the area adjacent the work surface, said apparatus comprising a reflector having inner surface means for at least partially defining a light bulb receiving cavity having front and rear end portions and for reflecting light from the bulb toward the front end portion of the cavity, electrical socket means for supporting a light bulb in said cavity, a flexible conduit connected in fluid communication with the rear end portion of said cavity, blower means connected in fluid communication with said flexible conduit means for inducing a flow of air and dust particles from the area adjacent the work surface through said cavity and into said conduit means, rigid concuit means for connecting said flexible conduit means with said blower means, connector means connected with the work surface for connecting said flexible conduit means in fluid communication with said rigid conduit means, and support means connected with said reflector for supporting said reflector above the work surface, said support means being adjustable to flex said conduit and change the position of said reflector relative to the work surface.

2. An apparatus as set forth in claim 1 wherein said electrical socket means is disposed in said cavity in a coaxial relationship with said conduit means to enable said electrical socket means to support the light bulb in the flow of air and dust particles.

3. An apparatus as set forth in claim 1 wherein said support means includes a base connected with the work surface, a plurality of rigid links and a plurality of connector means for pivotably interconnecting said links with each other, with said base and with said reflector.

4. An apparatus as set forth in claim 1 wherein said reflector has a generally frustro-conical configuration said front end portion of said reflector has a larger diameter than said rear end portion of said reflector, said electrical socket means being disposed in a coaxial relationship with said reflector and with said flexible conduit means.

5. An apparatus comprising a plurality of work surfaces, a blower having an inlet and an outlet, a manifold connected with each of said work surfaces and with the inlet to said blower, a plurality of flexible conduits each of which is associated with one of said work surfaces and has a first end portion connected to said manifold, a plurality of connector means each of which is fixedly connected with an associated one of said work surfaces for connecting said manifold in fluid communication with said flexible conduits, a plurality of reflectors each of which is associated with one of said work surfaces and is connected with a second end portion of an associated one of said flexible conduits, each of said reflectors having inner surface means for at least partially defining a light bulb receiving cavity having a rear end portion which opens into an associated one of said plurality of flexible conduits and a front end portion which opens toward the associated one of the plurality of work surfaces to enable said blower to induce a flow of air and dust particles from the area adjacent to the plurality of work surfaces through the plurality of reflectors, flexible conduits and the manifold to the inlet to said blower, a plurality of electrical socket means each of which is connected with one of said reflectors and is disposed in one of said cavities for supporting a light bulb in the flow of air and dust particles through the cavity, and a plurality of adjustable support means each of which is connected with an associated one of said work surfaces and an associated one of said reflectors for supporting the associated one of said reflectors at a location above the associated one of said surfaces, each of said support means being adjustable to flex the associated one of said flexible conduits and change the location of the associated one of said reflectors relative to the associated one of said work surfaces.

6. An apparatus as set forth in claim 5 wherein each of said support means includes a base which is fixedly connected with an associated one of said work surfaces, a plurality of rigid links, and a plurality of connectors which pivotably connects said links with each other, with said base, and with the associated one of said reflectors.

7. An apparatus for use in illuminating a work surface and removing dust particles from the area adjacent the work surface, said apparatus comprising a reflector having inner surface means for at least partially defining a light bulb receiving cavity having front and rear end portions and for reflecting light from the bulb toward the front end portion of the cavity, electrical socket means for supporting a light bulb in said cavity, a flexible conduit connected to and extending away from said reflector, said flexible conduit being connected in fluid communication with the rear end portion of said cavity, blower means spaced apart from said reflector and connected in fluid communication with said flexible conduit for inducing a flow of air and dust particles from the area adjacent the work surface, around a light bulb in said cavity, and into said flexible conduit, and support means separate from said flexible conduit and connected with said reflector for supporting said reflector above the work surface, said support means being adjustable to flex said conduit and change the position of said reflector relative to the work surface.

8. An apparatus as set forth in claim 7 wherein said electrical socket means is disposed in said cavity in a coaxial relationship with said flexible conduit to enable said electrical socket means to support the light bulb in the flow of air and dust particles.

9. An apparatus as set forth in claim 7 wherein said support means includes a base connected with the work surface, a plurality of rigid links and a plurality of connector means for pivotably interconnecting said links with each other, with said base and with said reflector.

10. An apparatus as set forth in claim 7 wherein said reflector has a generally frustro-conical configuration said front end portion of said reflector has a larger diameter than said rear end portion of said reflector, said electrical socket means being disposed in a coaxial relationship with said reflector and with said flexible conduit means.

11. An apparatus comprising a plurality of work surfaces, a blower having an inlet and an outlet, a manifold connected with each of said work surfaces and with the inlet to said blower, a plurality of flexible conduits each of which is associated with one of said work surfaces and has a first end portion connected to said manifold, a plurality of reflectors each of which is associated with one said work surfaces and is connected with a second end portion of an associated one of said flexible conduits, each of said reflectors having inner surface means for at least partially defining a light bulb receiving cavity having a rear end portion which opens into an associated one of said plurality of flexible conduits and a front end portion which opens toward the associated one of the plurality of work surfaces to enable said blower to induce a flow of air and dust particles from the area adjacent to the plurality of work surfaces through the plurality of reflectors, flexible conduits and the manifold to the inlet to said blower, a plurality of electrical socket means each of which is connected with one of said reflectors and is disposed in one of said cavities for supporting a light bulb in the flow of air and dust particles through the cavity, and a plurality of adjustable support means each of which is connected with an associated one of said work surfaces and an associated one of said refelectros for supporting the associated one of said reflectors at a location above the associated one of said surfaces, each of said support means being adjustable to flex the associated one of said flexible conduits and change the location of the associated one of said reflectors relative to the associated one of said work surfaces.

12. An apparatus as set forth in claim 11 wherein each of said support means includes a base which is fixedly connected with an associated one of said work surfaces, a plurality of rigid links, and a plurality of connectors which pivotably connects said links with each other, with said base, and with the associated one of said reflectors.

* * * * *

UNITED STATES PATENT AND TRADEMARK OFFICE

CERTIFICATE OF CORRECTION

PATENT NO. : 4,109,144

DATED : August 22, 1978

INVENTOR(S) : Albert J. Vidmar

It is certified that error appears in the above-identified patent and that said Letters Patent are hereby corrected as shown below:

Column 4, line 21 change "concuit" to --conduit--.

Column 6, line 36 change "refelectros" to --reflectors--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*